US006748617B1

(12) United States Patent
Toycen et al.

(10) Patent No.: US 6,748,617 B1
(45) Date of Patent: Jun. 15, 2004

(54) DOUBLE-CRIMPER FOR BLASTING CAPS

(75) Inventors: Jeffrey E. Toycen, Ottawa (CA); Darryl L. Aspey, 11533 Tottenham Pl., Richmond, VA (US) 23233; Darin J. Goodwiler, 107 Bentley Ct., Stafford, VA (US) 22554

(73) Assignees: EOD Performance Inc., Ottawa (CA); Darryl L. Aspey, Richmond, VA (US); Darin J. Goodwiler, Stafford, VA (US)

( * ) Notice: Subject to any disclaimer, the term of this patent is extended or adjusted under 35 U.S.C. 154(b) by 1710 days.

(21) Appl. No.: 08/644,170

(22) Filed: May 10, 1996

(51) Int. Cl.[7] ..... B25B 7/22

(52) U.S. Cl. ..... 7/129; 7/107; 81/900; 81/426.5

(58) Field of Search ..... 7/129, 107, 418, 7/419, 426.5; 81/900, 416; 72/409.01

(56) References Cited

U.S. PATENT DOCUMENTS 610,305 A * 9/1898 Mino et al. ..... 7/129
1,299,103 A * 4/1919 Angle ..... 81/419
1,640,089 A * 8/1927 Murphy ..... 7/129
2,335,580 A * 11/1943 Chirelstein ..... 81/419
2,784,621 A * 3/1957 Klingler ..... 7/107
2,930,277 A * 3/1960 Jennerman ..... 7/129
2,952,175 A * 9/1960 Edlen et al. ..... 8/426.5
2,978,353 A * 4/1961 Meier ..... 81/900
4,109,845 A * 8/1978 Wedge et al. ..... 81/423
4,719,789 A * 1/1988 Wiebe et al. ..... 7/107
4,822,458 A * 4/1989 Ogden
5,560,269 A * 10/1996 Zelenka ..... 81/125

* cited by examiner

*Primary Examiner*—James G. Smith
(74) *Attorney, Agent, or Firm*—Ronald G. Bitner

(57) ABSTRACT

A pliers-type of crimper for blasting caps adapted for forming a double crimp in a single operation. For safety, the crimper is constructed of a lightweight non-sparking and non-magnetic material, specifically, aluminum, which is provided with a heavy dense anodic coating to provide the desired wear properties. The use of aluminum facilitates the forming of the intricate crimping elements in an integral structure for low cost.

3 Claims, 2 Drawing Sheets

DOUBLE-CRIMPER FOR BLASTING CAPS

FIELD OF THE INVENTION

This invention relates to a hand operated crimping tool for blasting caps, and particularly to a pliers-type double crimper incorporating safety features.

BACKGROUND OF THE INVENTION

Crimpers for blasting caps in common use today are similar to that shown in U.S. Pat. No. 999,133 to H. R. Taylor. Present pliers-type crimpers typically include a single pair of crimping elements, and include other tool features, such as fuse/cord cutters and a powder punch on one of the handles.

A crimping device for performing a double crimp on blasting caps is disclosed in U.S. Pat. No. 2,697,376 to G. R. Dixon. The design of this crimper is relatively complex and bulky and is not as portable as a pliers-type crimper.

A pliers-type of crimper for double crimping presents difficulties in manufacture due to the need for a closely and precisely spaced pair of crimping elements. One obvious approach for the manufacture of crimper jaws with the required intricate elements might involve the use of multiple components that would be fastened together to form each jaw. However, such construction adds to the complexity and cost of manufacture.

For safety it is desirable that a crimper also be non-sparking and non-magnetic. Materials that have the desired properties, such as titanium and beryllium-copper, are relatively expensive, and titanium is difficult to machine. Although aluminum has the desired properties in terms of ease of manufacture and is also non-sparking and non-magnetic, aluminum itself does not have the desired wear properties.

For military use, additional features are required or desirable. Specifically, the crimper should be non-reflective and leave no magnetic signature, for reduced detectability in the field.

SUMMARY OF THE INVENTION

An object of the present invention to provide a pliers-type of crimper capable of performing a double crimp in a single operation.

A more specific object of the present invention is to provide a relatively inexpensive double crimper incorporating safety features, including non-sparking and non-magnetic properties suitable for use with blasting caps.

It has been found that an effective, relatively inexpensive, lightweight, and safe double crimper can be constructed of aluminum, which is readily machinable, and can be treated to provide suitable wear properties.

The present invention provides a pliers-type crimping tool for blasting caps, comprising a pair of pivotally connected jaws, each jaw having a pair of crimping elements operative for forming a double crimp in a single jaw closing operation, said crimping tool composed of aluminum for providing non-sparking and non-magnetic properties, and wherein the outer surfaces of the aluminum are provided with a dense anodic coating to enhance wear properties.

In the preferred embodiment of the invention each pair of crimping elements-are formed integrally as part of each of the jaws.

DESCRIPTION OF THE PREFERRED EMBODIMENTS

Figure 1:
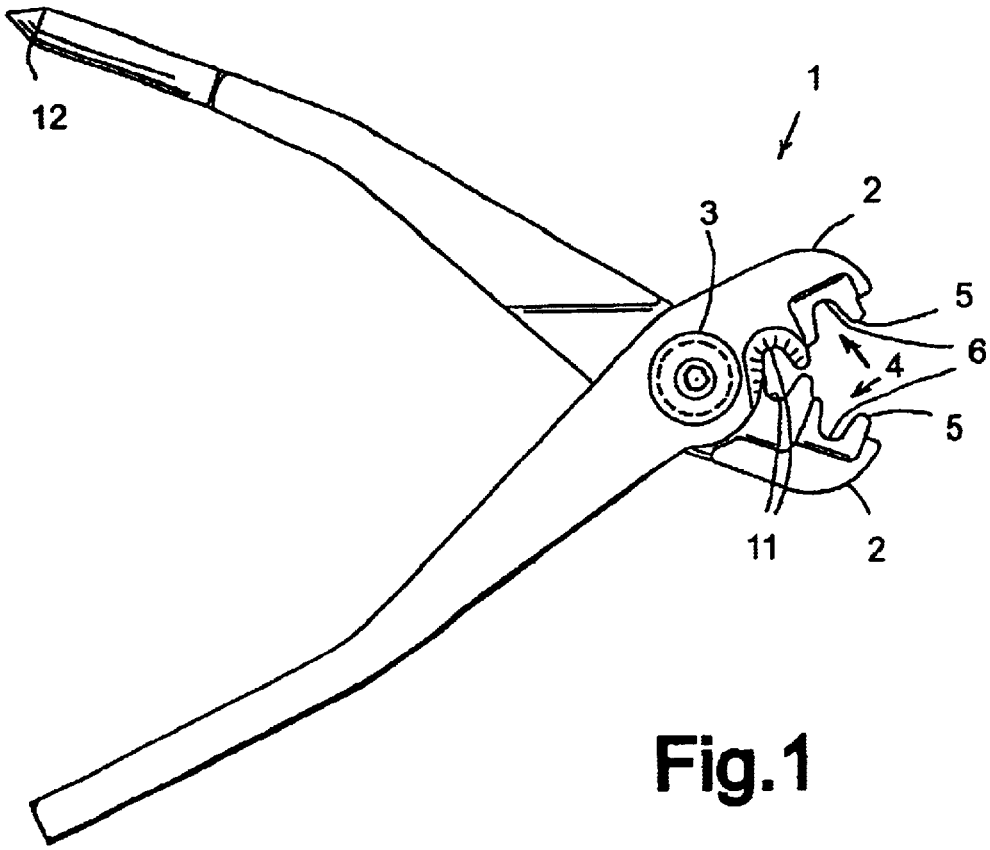
FIG. 1 illustrates an embodiment of the crimper with jaws open.
Figure 3:
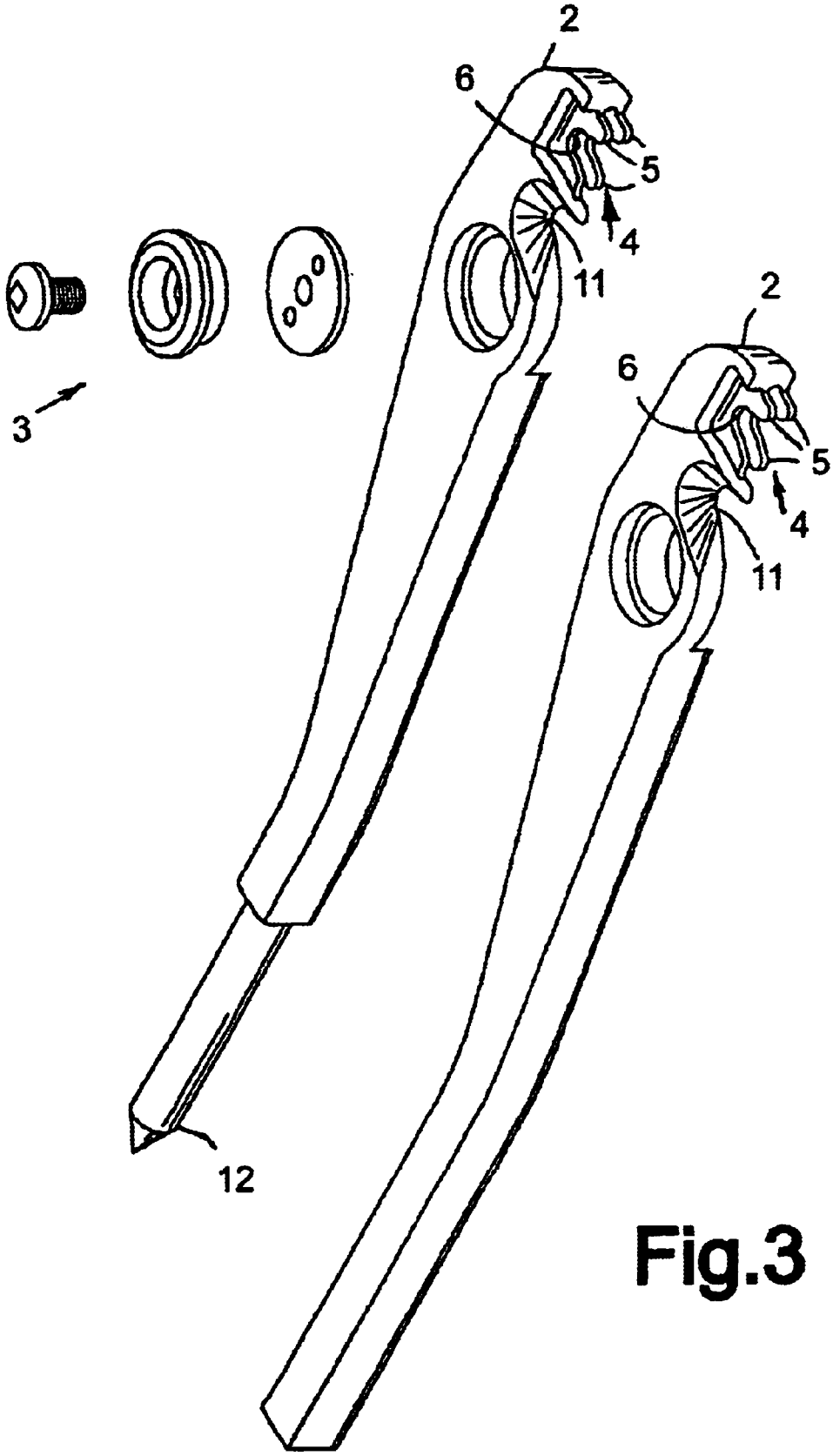
FIG. 3 shows the jaws of the crimper, of FIGS. 1 and 2, separated and reveals the arrangement of the double crimping elements.

With reference to the drawings, the present invention comprises a pliers-type of crimper 1 having a pair of jaws 2 pivotally connected by a suitable pivot 3. As best seen in FIGS. 1 and 3, each jaw 2 has a pair of spaced crimping elements 4.

Figure 2:
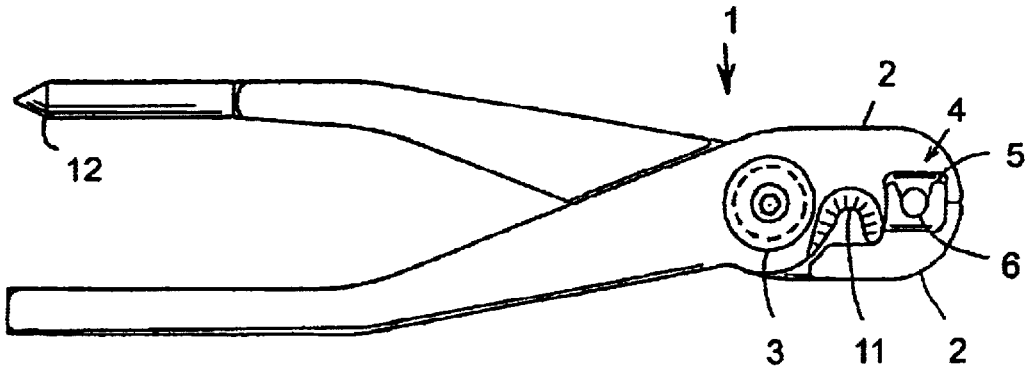
FIG. 2 illustrates an embodiment of the crimper with jaws closed.

Each crimping element comprises a pair of spaced guiding/centering portions 5 disposed on each side of the crimping surface 6. The central crimping surfaces 6 define a substantially circular shape when the jaws are closed (see FIG. 2). The pair of crimping elements 4 are interleaved such that the guide portions 5 overlap when the jaws are closed as seen in FIG. 2. This arrangement of double crimping elements 4 forms a double, circumferentially uniform crimp in a single jaw closing operation.

For safety, the crimper is constructed of a non-sparking and non-magnetic material, specifically aluminum. Aluminum leaves no magnetic signature so that it is undetectable by magnetic scanners, making it particularly suitable for military use.

The crimper, being made of aluminum, is readily machinable to facilitate forming the intricate and precisely arranged crimping elements 4, and allows each jaw to be constructed from a single integral piece of material.

To provide the aluminum material with the desired wear properties the, crimper surfaces is treated electrolytically to provide a heavy dense hard anodic coating.

In the wear susceptable regions, in particular, the anodic coating should have a thickness of at least 0.001 inches, and preferably at least 0.0015 inches.

The anodic coating also provides the crimper with a non-reflective surface providing low visability for military applications.

A further inherent advantage obtained by the use of aluminum is that it provides a lightweight tool, enhancing its portability.

The drawings show the crimper 1 provided with additional integrally formed tool elements, including cutters 11 to cut safety fuse or detonation cord, and a powder punch 12 on one of the handles.

EXAMPLE

A crimper as illustrated in the drawings, and described generally above, was machined from Aluminum 6061-T6. The machined crimper was given an anodic treatment in accordance with US. Military Specification MIL-C-8625F, Type 3, Class 1, to provide a dense hard (Type 3) coating of 0.002 inch. The coated crimper was sealed (Class 1) to enhance abrasion,and corrosion resistance. The coated crimper was found to have a hardness of Rockwell C60. The coating produced a greenish gray surface that is non-reflective for low visibility. The crimper produced circumferentially uniform double crimps without tearing of blasting caps, and conformed with U.S. Military Specification MIL-C-43438D.

What is claimed is:

1. A pliers-type crimping tool for blasting caps, comprising a pair of pivotally connected jaws, each jaw having a pair of crimping elements formed integrally as part of the respective jaw and operative for forming a double crimp in a single jaw closing operation, said crimping tool composed of aluminum for providing non-sparking and non-magnetic properties, and wherein the outer surfaces of the aluminum are provided with a dense anodic coating to enhance wear properties, and wherein outer surfaces of the aluminum that are susceptible to wear are provided with an anodic coating having a thickness of at least 0.001 inch.

2. The crimping tool of claim 1, wherein outer surfaces or the aluminum that are susceptible to wear are provided with an anodic coating having a thickness of at least 0.0015 inch.

3. The crimping tool of claim 1, further comprising a pair of cutting elements which cooperate with one another to provide cutters.

* * * * *